United States Patent [19]

McLaughlin

[11] 4,125,979

[45] Nov. 21, 1978

[54] CONSTRUCTION UNIT

[76] Inventor: Robert R. McLaughlin, J1.
Baranangirang, Bogor, Indonesia

[21] Appl. No.: 766,375

[22] Filed: Feb. 7, 1977

[51] Int. Cl.[2] ..... E04B 5/04

[52] U.S. Cl. ..... 52/259; 52/602; 52/606

[58] Field of Search ..... 52/223 R, 223 L, 225, 52/731, 732, 433, 729, 259, 258, 428, 425, 426, 415, 615, 250, 251, 405, 309.11, 309.12, 612, 596, 606, 602

[56] References Cited

U.S. PATENT DOCUMENTS

| | | | |
|---|---|---|---|
| 2,170,165 | 8/1939 | Strong | 52/596 X |
| 2,673,459 | 3/1954 | Overhulse | 52/259 |
| 3,475,529 | 10/1969 | Lacy | 52/223 R |
| 3,821,869 | 7/1974 | Morgan | 52/259 |

FOREIGN PATENT DOCUMENTS

| | | | |
|---|---|---|---|
| 1,210,389 | 3/1960 | France | 52/596 |

*Primary Examiner*—Price C. Faw, Jr.
*Assistant Examiner*—Carl D. Friedman
*Attorney, Agent, or Firm*—Irons and Sears

[57] ABSTRACT

Lightweight and structurally efficient construction or building units of cementitious materials and the method of making these units. Prefabricated cementitious strips or slabs are aligned with their longitudinal axes parallel and rigidly held in the desired orientation with each other, preferably with the use of spacer/connectors. Stressed or unstressed reinforcement elements can also be placed parallel to the lines of junction between the strips or slabs by attaching them to the spacer/connectors. Continuous prisms of cementing material or cement mortar are then applied along the junction of the strips or slabs and around the reinforcement to structurally bond all the components into an integral unit. The units are characterized by a constant cross section of relatively thin structural parts and voids normal to a major longitudinal axis. They can be massive or small depending on the particular application for which they are made.

1 Claim, 13 Drawing Figures

CONSTRUCTION UNIT

CROSS-REFERENCE TO RELATED APPLICATION

This invention is not disclosed in any co-pending application for a patent or any issued patent. It is disclosed in Disclosure Document No. 05 1,254 filed July 30, 1976.

BACKGROUND OF THE INVENTION

This invention pertains to cementitious construction units of relatively light weight and high strength.

Production of precast concrete beams, slabs and blocks is common. Development of special materials and techniques have greatly increased the range of useful applications of such beams, slabs and blocks and allowed use of smaller, lighter members than previously possible. Still, weight of concrete members has remained a major area of concern to engineers.

Efforts to reduce the weight of concrete units for particular applications have been directed in two general directions. One way has been to reduce the weight of concrete members by casting shapes, for instance, having a Tee, I, channel or hollow cross section. These units can be said to represent rectangular members from which some of the concrete has been taken out in order to save weight. Because the concrete which is left out is in low efficiency areas, the weight decrease is proportionally greater than the strength decrease. Therefore, a lighter member can be made to serve a particular purpose. However, there are limitations to the thinness of the solid portions of the cross section with the methods of manufacture currently in use because of the low tensile strength of plain concrete and the difficulty of placing it in thin-walled monolithic sections. In addition, disruption of strength and integrity occurs from concrete settlement and void form movements while thin concrete sections cast monolithically are hardening.

Another means of producing members by selective placement of concrete in thin sections is extrusion. In this method limitations arise because of support requirements for the thin sections while they are still plastic. In order to keep the product from slumping it is necessary to limit thinness and to utilize rigid trays, forms or storage racks during the curing period.

The second general direction of the efforts to reduce the weight of concrete members has been to use lower density concrete. A decrease in the density of the concrete can be achieved by the utilization of a foaming process or by mixing with very low density fillers. With either method the effect is to lower the strength and modulus of elasticity in essentially direct proportion to the density below a certain point. This technique amounts to indiscriminate removal of solid material from the cross section of the unit, that is, from areas of high structural efficiency as well as from the less efficient areas.

The ability of a structural member to withstand bending and compression column forces is dependent on the size and shape of its cross section. Assuming that the material properties are constant, the strength of a member will vary in proportion to the area, moment of inertia and section modulus of its cross section. Also, for any given cross-sectional area and loading pattern there are certain loci of points which represent the most structurally advantageous positions for placement of the solid material. For instance, in the case of a long member designed to resist bending about a particular axis, as in the case of a beam or wall section, the advantageous loci of points are lines parallel to the axis, located on each side of the axis and as far removed from the axis as the design limitations of the cross section will allow. Thus, the most advantageous use of any material is accomplished by locating as much material as near as possible to the lines previously described. The portions of the unit located near these lines are generally referred to as flanges. The thickness of the flanges required for a particular unit depends on the properties of the material used as well as the forces to be resisted.

In addition, a member must be able to resist shearing forces so as to maintain the relative position of the flanges and to cause the flanges to act integrally as a unit rather than individually. This is accomplished by connecting the flanges with webs, usually lying perpendicular to the flanges and connected to them with sufficient strength to resist the shearing forces.

The most usual cross-sectional shapes which are formed by combination of flanges and webs to take advantage of these principles are the I and the hollow box. The latter can be equated to two I sections joined side by side. However, other structurally advantageous shapes can be made by various combinations of webs and flanges. The basic principle for achieving an optimum combination of strength and lightness is to make members with a cross section comprising voids and solid portions wherein the solids are placed in accurate relation to one another so as to occupy the most structurally advantageous positions in the unit, that is, to serve as the flange and web portions of the unit as described above.

If long members with thin walls are produced by casting monolithically in forms or by extrusion, handling and storage problems while the cemented material is still plastic are considerable. Furthermore, the thin walls will likely be fragile. However, thin sections of excellent integrity, strength and uniformity can be preformed as sheets or slabs in the flat position. An example is asbestos cement sheet which is commonly manufactured with as little as one-eighth inch thickness. Reinforcing and strengthening by addition of fibers or polymers are processes which can be easily employed to best advantage in the flat position. For instance, orientation of fibers is possible by combing and the surfaces are fully available for control of fiber protrusion. Application and penetration of monomer are facilitated, and polymerization by either heat or radiation can be accomplished throughout the depth of the sheet or slab with precision and efficiency not possible otherwise. Additionally, forming cemented material into flat strips or slabs does not require expensive molds and the necessary storage area is minimized because the sheets or slabs can be laid on top of one another without any space between them. Finally, after hardening and curing, the flat sheets or slabs can be throughly inspected, and tested, if desired, to ascertain their suitability for structural purposes. Thus, in a system employing precast or preformed strips or slabs in the manufacture of construction units, the strength and integrity of thin walls could be completely assured prior to fabrication.

A considerable advantage of my invention is that it is feasible to deploy basic precast or precut materials and subassemblies for final fabrication at or near point of use. The sub-assemblies could include precut strips or sheets of cemented material, bags of premixed mortar for the continuous prisms and prefabricated reinforcing harnesses. The major component, the rigid strips or slabs of preformed cemented material, could be packaged very compactly and could be easily protected against damage when shipped in stacks. At the point of use, a fabrication facility to perform the simple operations for unit assembly and extrusion or placement of the continuous bonding prisms would require little investment in plant facilities and relatively small numbers of skilled laborers. These advantages make the invention particularly appropriate for use at remote military installations, construction facilities, town developments and self-help housing projects in developing regions.

SUMMARY OF THIS INVENTION

My invention which will now be described, makes use of these facts and principles in the fabrication of highly efficient, lighter weight, construction units from rigid strips or slabs of precast or preformed cementious material. Combinations of the rigid strips or slabs are assembled so that the solid parts occupy the most favorable structural portion of the unit's cross section and the remainder is left void. In the particular embodiment described, the strips or slabs are adhesively attached to a series of spacer/connectors which maintains the strips or slabs in the desired position relative to each other. Reinforcing wires, rods, strands or filaments can also be attached to the spacer/connectors to form a reinforcement harness and thereby be rigidly fixed parallel to the line of junction between the strips or slabs. The parts thus assembled are then further structurally bonded by application of prisms of cementing material or cement mortar to the junctions of the assembled parts.

BRIEF DESCRIPTION OF DRAWINGS

The advantages of my invention will become more fully apparent as the description of the invention is read in conjunction with the accompanying drawings.

DETAILED DESCRIPTION OF THE INVENTION

Figure 1:
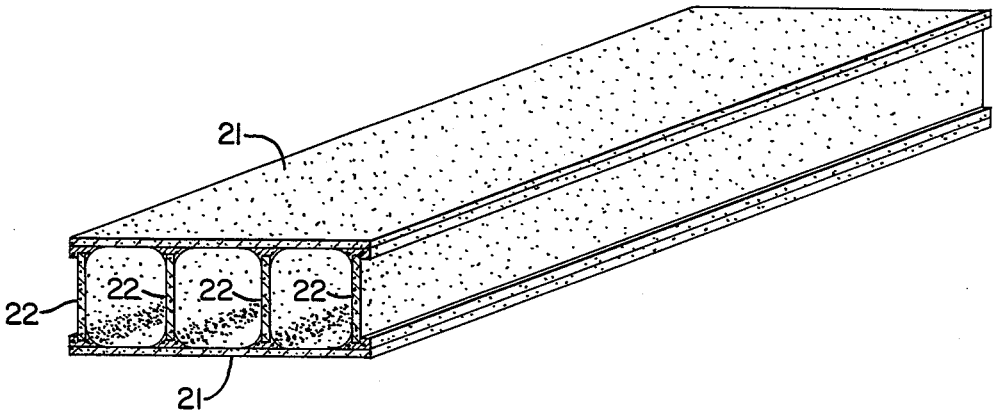
FIG. 1 is a perspective view of a completed building or construction unit in one of the many possible configurations of the present invention.
Figure 2:
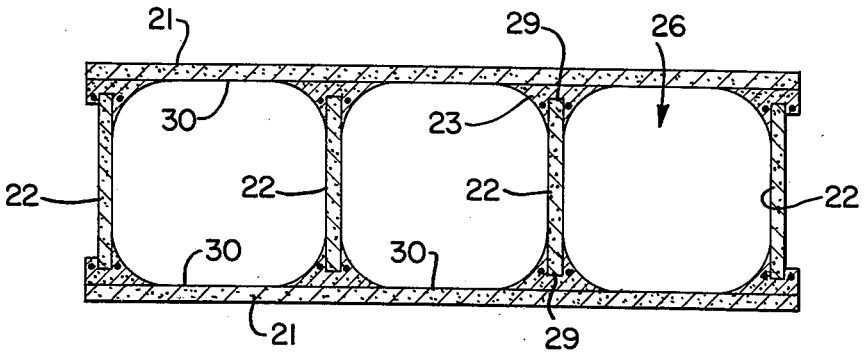
FIG. 2 is a cross-sectional view of the unit depicted in FIG. 1 taken anywhere along its length.
Figure 11:
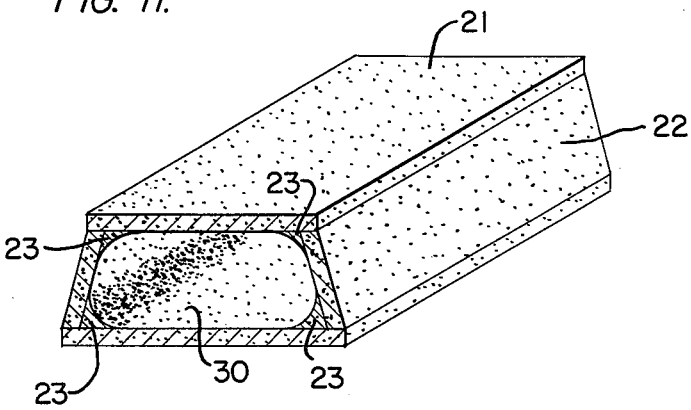
FIG. 11 is a perspective view of another possible configuration of a completed building or construction unit of the present invention.

Referring now in detail to the several Figures, completed units having possible configurations are shown in FIGS. 1 and 11. The units can be of any length. The cross section of the unit depicted in FIG. 1, shown in FIG. 2, is of constant shape throughout its length.

Figure 3:
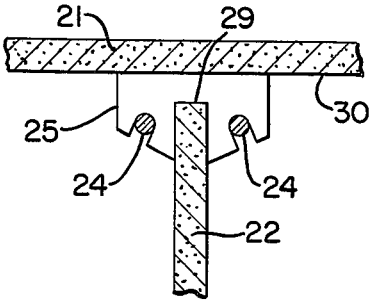
FIG. 3 is an end view of a spacer/connector serving to maintain the desired spatial relationship among the strips or slabs and reinforcement elements in the present invention.
Figure 4:
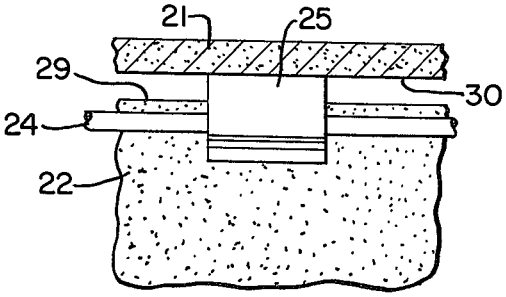
FIG. 4 is a side view of a spacer/connector serving to maintain the desired spatial relationship among the strips or slabs and reinforcement elements in the present invention.

The particular configuration depicted in FIGS. 1 to 4 comprises precast or preformed rigid cementitious strips or slabs as flanges, 21, and webs, 22; continuous prisms of cementing material or cement mortar, 23; wire, rod, strand or filament reinforcing, 24; and void spaces or unit cells, 26. FIG. 3 shows an end view of one possible form of a spacer/connector, 25. FIG. 4 shows a side view of a spacer/connector, 25. A number of these spacer/connectors, 25, which are placed at appropriate intervals along the length of the unit, hold the reinforcing, 24, in proper relationship to the other structural elements and through adhesive action are the connectors which bind the flanges, 21, and webs, 22, in rigid and accurate relationship to each other during fabrication.

Variations of the configuration of the units are possible and in certain cases desirable. There are a multitude of possible cross section sizes and shapes which could be produced in addition to that shown in FIG. 2. For instance, beam-like units with a single closed cell, slab-like units with rows of closed or semi-closed cells, Tee or multi-Tee units, channel units and Ell units can be constructed. Even units wherein the flanges, 21, and the webs, 22, are not perpendicular to each other, as depicted in FIG. 11, can be made.

The precast or preformed strips or slabs may be connected in the appropriate configuration of webs, 22, and flanges, 21, by adhesive joinder between the lateral edges, 29, of the webs, 22, and the inner surfaces, 30, of the flanges, 21, and the application of the continuous prisms of cementing material or cement mortar, 23, along the junction of the webs, 22, and flanges, 21. Alternatively, the lateral edges, 29, of the webs, 22, and the inner surfaces, 30, of the flanges, 21, are spaced apart. The space is filled with, and the webs, 22, and flanges, 21, are bonded together by, the cementing material or cement mortar, 23.

Preferably, however, the precast or preformed strips or slabs may be connected in the appropriate configuration of webs, 22, and flanges, 21, by adhesive joinder with spacer/connectors, 25, such as are depicted in FIGS. 3 and 4. This can be done so that the webs, 22, and the flanges, 21, are positioned normal to one another as depicted in FIGS. 1 and 2 or in other appropriate configurations, for example, as shown in FIG. 11. These spacer/connectors, 25, which are adhesively joined to the cement strips or slabs, serve to maintain the cementitious strips or slabs in the desired configuration of webs, 22, and flanges, 21, before and during the application of continuous prisms of cementing material or cement mortar 23.

Figure 9:
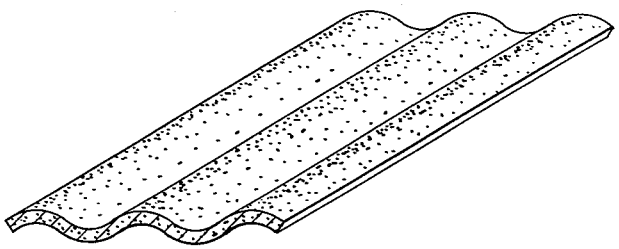
FIGS. 9 and 10 illustrate possible configurations of the cementitious strips or slabs which may be used as alternatives to a flat strip or slab in the present invention.
Figure 10:
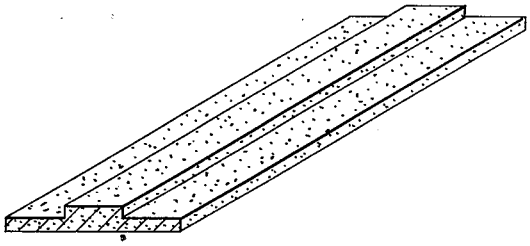

The precast strips or slabs utilized as webs, 22, and flanges, 21, need not be flat as shown in FIGS. 1 through 8, 11, 12, and 13. These strips or slabs can be in many possible shapes, for example, as shown in FIGS. 9 and 10. The shape, material and fastening means of the spacer/connectors, 25, can also be varied. They can be made of plastic, metal, cement or other appropriate material. Also, the shape of the spacer/connector, 25, may be as shown in FIG. 3 and FIG. 4, or in any other shape which serves the intended purpose. These spacer/connectors, 25, may be fastened to the flanges, 21, and webs, 22, with adhesive, by fusion or by any other suitable method.

The continuous prisms of cement mortar or cementing material, 23, serve a threefold purpose. First they provide the necessary continuous bonding action between the webs and flanges of the unit. Second, they form an integral part of the structural cross section of the unit which contributes to the area, moment of inertia and section modulus of the unit. And third, they provide corrosion and fire protection for any reinforcing elements included therein.

Soon after application of the continuous prisms of cementing material or cement mortar, 23, the units can be moved and stacked without forms or molds because they are rigid in themselves. Use of quick hardening cementing material or cement mortar for bonding the flanges, 21, and webs, 22, of the assembled unit will allow early trimming and dressing operations after which time the completed units can be shipped, stored or immediately utilized.

The size of the prisms, 23, and the material used therein can be varied. For example, when lower density, lower strength cementing material or cement mortar is used for the continuous prism, 23, their size must necessarily increase accordingly. In their most expanded form, they might fill the unit cells, 26, in their entirety.

Figure 12:
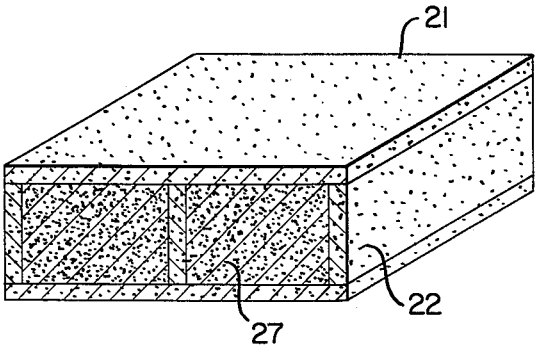
FIG. 12 is a perspective view of a completed building or construction unit of the present invention in which the voids are entirely filled with a lightweight filler material.
Figure 13:
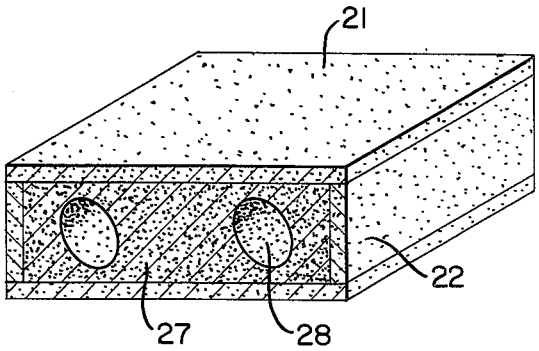
FIG. 13 is a perspective view of a complete building or construction unit of the present invention in which the voids are partially filled with a lightweight filler material.

Alternatively, lightweight filler material, 27, for example, low density cementing material, can be placed in the voids to totally or partially fill the voids, 28, as shown in FIGS. 12 and 13, respectively. This lightweight filler material, 27, can be used as a substitute for, or supplement to, the cementing material or cement mortar, 23. The filler material, 27, would thereby act as a bonding material to transfer shear stresses, hold the relative positions of the structural elements and perhaps serve as insulation. In the embodiments shown in FIGS. 12 and 13 there are no prisms of cementing material; the filler serving as a substitute for, and not merely a supplement to, the cementing material.

Additional strength can be given to the structural units by placing reinforcement elements parallel to the flanges of the units. These reinforcement rods, strands, wires, or filaments, 24, can be adhesively or mechanically attached to the spacer/connectors, 25, and further secured by positioning the reinforcement, 24, so that the prisms of cementing material or cement mortar, 23, applied to bond the various parts of the assembled unit completely surround them. Further strength can be given by applying tension to the reinforcement elements, 24 prior to cementing. The stiffness of the partially assembled unit can serve to hold the tension during curing. When the cementing material is applied and hardens, a unit with pretensioned reinforcement is obtained.

Figure 5:
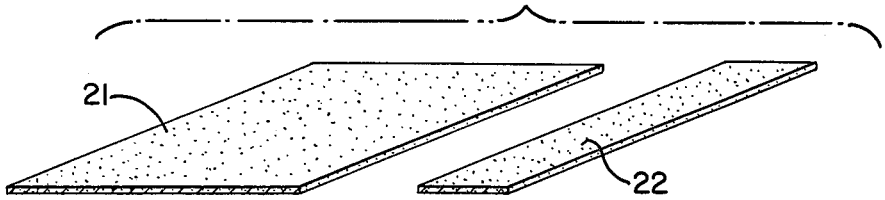
FIG. 5 is a perspective view of the cementitious slabs or strips of the present invention prior to manufacture.
Figure 6:
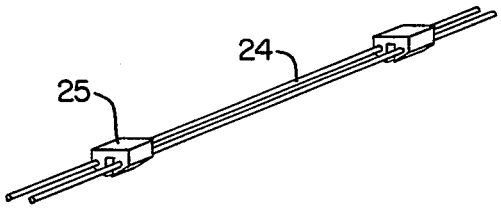
FIG. 6 is a perspective view of the spacer/connectors and the reinforcing rods of the present invention as a first stage of manufacture.
Figure 7:
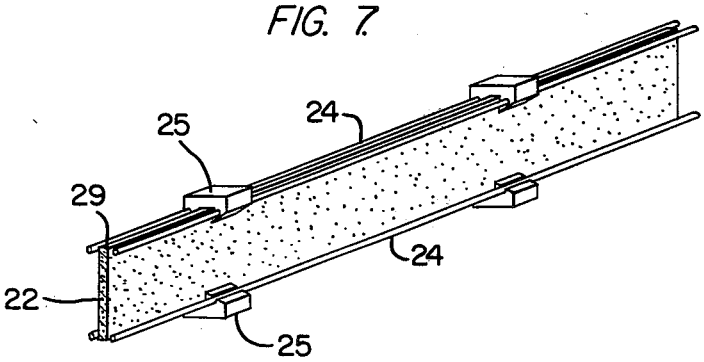
FIG. 7 shows the spacer/connectors and reinforcing elements assembled on the strips during manufacture.
Figure 8:
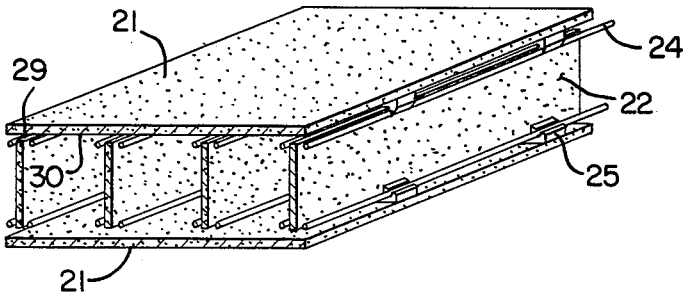
FIG. 8 shows all of the elements of the invention disclosed in FIGS. 5, 6 and 7 arranged after manufacture.

FIGS. 5, 6, 7 and 8 schematically illustrate the steps in the method of fabrication which begins with the preparation of sub-assemblies. FIG. 5 shows a rigid flange, 21, and a web, 22, which have been precast or preformed of cementitious material either to the desired dimensions or subsequently cut to the proper size. FIG. 6 shows reinforcing elements, 24, which have been adhesively or mechanically fitted with spacer/connectors, 25, at the appropriate intervals to make a reinforcing harness. FIG. 7 shows four such spacer/connectors, 25, attached to one of the web strips or slabs, 22, to which it is rigidly fastened by adhesive or other appropriate means. FIG. 8 shows four of the sub-assemblies accurately positioned in conjunction with two flange strips or slabs, 21, and four web strips or slabs, 22, as they are held in a jig. Adhesive which is applied between the spacer/connectors, 25, and the flange strips or slabs, 21, renders the entire assembly rigidly connected and accurately positioned. The spacer/connectors, 25, are shaped so that the assembled flange and web strips or slabs, 21 and 22, respectively, are not actually in contact with each other.

It is possible to pretension the reinforcing elements, 24, at this stage of manufacture, using only the stiffness of the assembled, but as yet unfinished, unit to hold the tension. This is an important advantage in supplying pretension to the reinforcement without expensive forms and bulkheads to resist the tension forces while the product is hardening.

At this state of the fabrication, the various elements are rigidly fastened together but they are not yet structurally competent because continuous bonding to assure composite action of the various elements is absent. In order to accomplish this, a continuous prism of cementing material or cement mortar, 23, is applied along all the junctions between flange and web strips or slabs, 21 and 22, respectively. The continuous prisms, 23, may be applied by an extruding device which travels inside the unit cells, 26, and forces the cementing material, 23, to fill all voids, surround all objects and adhere to all surfaces within he prism area, including the spacer/connectors, 25, and reinforcement, 24. The disadvantages inherent in extruding entire sections are not present in this application. The extruded portions are relatively small and do not slump or deform because shape and position is maintained by adhesion to the rigidly assembled flanges, 21, and webs, 22.

The method of placement of the continuous prisms, 23, may be varied. For instance, in larger units, they may be more easily produced by applying the material through tubes or chutes and vibrating the material into place against movable restraining plates or forms. Application of a primer, such as epoxy resin to the surfaces prior to placement can enhance adhesion.

Finally, as shown in FIGS. 12 and 13, lightweight filler material, 27, can be added to totally or partially fill the unit cells, 26. Where the unit cells, 26, are only partially filled, voids, 28, are left unfilled. If this filler material, 27, is intended as a substitute for and not merely a supplement to the cementing material, 23, then the application of this filler is the only step which serves to provide continuous bonding. Thus, the step in which the continuous prisms, 23, are applied can be omitted in such case.

Although the present invention has been described with reference to a particular embodiment thereof, it should be understood that those skilled in the art may make other modifications and embodiments thereof which will fall within the spirit and scope of the principles of this invention.

What is claimed as new and desired to be secured by patent of the United States is:

1. A building construction unit comprising (a) A pair of equal sized preformed elongated cementitious flanges, each having a straight major axis and a constant cross section normal thereto;

(b) a plurality of equal sized preformed elongated cementitious webs each having a straight major axis and a constant cross section normal therto;

(c) each of said cementitious flanges and webs having internal reinforcing means;

(d) a plurality of elongated reinforcing rods;

(e) a plurality of equal sized spacer/connectors each having a flat surface for contacting the inner surface of a flange, an aperture for fitting over the edge of a web and additional apertures to receive the reinforcing rods;

(f) said elongated cementitious flanges having their major axes parallel to each other and their major planes parallel to each other;

(g) said elongated cementitious webs having their major axes parallel to each other and to the major axes of said flanges and their major planes parallel to each other;

(h) said webs having said spacer/connectors attached at intervals over both edges of their length;

(i) said spacer/connectors receiving and holding said reinforcing rods;

(j) said inner surface of said flanges adhesively joined to the flat surfaces of said spacer/connectors; and, (k) continuous prisms of cementing material along the junction between the flanges and the webs, enclosing said spacer/connectors and said reinforcing rods and providing structural strength to said building unit.

* * * * *